US007254844B1

(12) United States Patent
Thomas-Hansen

(10) Patent No.: US 7,254,844 B1
(45) Date of Patent: Aug. 14, 2007

(54) WASTE BAG HOLDING ASSEMBLY

(76) Inventor: Cynthia Thomas-Hansen, 815 Truex Ct., Idaho Falls, ID (US) 83401

( * ) Notice: Subject to any disclaimer, the term of this patent is extended or adjusted under 35 U.S.C. 154(b) by 463 days.

(21) Appl. No.: 11/035,274

(22) Filed: Jan. 13, 2005

Related U.S. Application Data

(63) Continuation-in-part of application No. 10/652,945, filed on Aug. 29, 2003, now abandoned.

(51) Int. Cl.
*A47K 11/00* (2006.01)

(52) U.S. Cl. ..... 4/144.2; 4/144.1; 4/144.3; 4/484

(58) Field of Classification Search ..... 4/144.1, 4/144.2, 144.3, 451, 452, 484; 604/355
See application file for complete search history.

(56) References Cited

U.S. PATENT DOCUMENTS

| | | | | |
|---|---|---|---|---|
| 3,002,194 | A | 10/1961 | Wuest | |
| 3,095,578 | A | 7/1963 | Stanford | |
| 3,249,950 | A | 5/1966 | Wilson | |
| 3,422,985 | A | 1/1969 | Rinehart | |
| 3,428,967 | A | 2/1969 | Hughes | |
| 3,600,719 | A | 8/1971 | Karr | |
| 3,936,890 | A | 2/1976 | Oberstein | |
| 3,952,336 | A | 4/1976 | Kunter et al. | |
| 4,202,058 | A * | 5/1980 | Anderson | 4/144.3 |
| 4,665,571 | A | 5/1987 | Muccione | |
| 4,840,625 | A | 6/1989 | Bell | |
| 4,996,727 | A | 3/1991 | Wyatt | |
| 5,007,116 | A | 4/1991 | Yamamoto | |
| 5,155,871 | A | 10/1992 | Sams | |
| 5,170,516 | A * | 12/1992 | Davison | 4/484 |
| 5,342,332 | A | 8/1994 | Wheeler | |
| 5,732,418 | A | 3/1998 | Sekitou | |
| 5,950,251 | A | 9/1999 | Cost et al. | |
| 6,047,414 | A | 4/2000 | Bailey | |
| 6,070,277 | A | 6/2000 | Thomas | |
| 6,079,058 | A | 6/2000 | Green | |
| 6,098,210 | A | 8/2000 | Broden | |
| 6,115,855 | A | 9/2000 | Lorenzo | |
| 6,119,280 | A | 9/2000 | Rentsch | |
| 6,151,721 | A | 11/2000 | Whitfield | |
| 6,163,892 | A | 12/2000 | Abbato | |
| 6,186,990 | B1 | 2/2001 | Chen et al. | |
| 6,199,220 | B1 | 3/2001 | Smith | |
| 6,202,224 | B1 | 3/2001 | Freeman | |
| 6,202,225 | B1 | 3/2001 | Beck et al. | |
| 6,220,753 | B1 | 4/2001 | Metzger | |

* cited by examiner

*Primary Examiner*—Robert M. Fetsuga
(74) *Attorney, Agent, or Firm*—Rigby, Andrus & Moeller, Chartered

(57) ABSTRACT

A waste bag holding assembly for securely holding a waste bag in not only an open position but also in a shape conforming to a user's shape to facilitate use of the waste bag includes a bag connection member that snugly engages a body conforming rim of a frame to securely hold the waste bag in an open position when placed between a pair of user's legs and adjacent to an anus and a urethral opening of the user.

12 Claims, 9 Drawing Sheets

WASTE BAG HOLDING ASSEMBLY

PRIOR APPLICATION

This application is a continuation-in-part of U.S. patent application Ser. No. 10/652,945 filed Aug. 29, 2003 now abandoned, the application being incorporated herein by this reference.

TECHNICAL FIELD

The present invention relates to bag holders and more particularly to a new waste bag holding assembly for securely holding a waste bag in not only an open position but also in a shape conforming to a shape of a portion of a user to facilitate use of the waste bag.

BACKGROUND OF THE INVENTION

The present invention addresses problems encountered in the capture and disposal of waste, particularly that expelled from an anus, a urethra, a vagina and a penis of a human user. While many devices have been used to facilitate capture and disposal of such human waste, comparatively few are both reusable and easily portable. Among these devices which are reusable and portable, most are designed for seated use only, many are large, cumbersome or bulky, and some require tools or significant time to assemble, use and disassemble. Still others require inflation before use. Yet others are designed to capture fluid waste only and not for the directing and capture of both solid and liquid waste or for the directing and capture of waste expelled simultaneously from a user's anus and a user's urogenital systems.

Although various waste bags and bag holders and other portable devices for receiving waste are known in the art, the need remains for an improved, durable, portable and reusable assembly conforming to a shape of a user's inner thighs, which may be comfortably positioned and held between the user's legs and which securely and firmly holds, positions and shapes a waste bag to a portion of a non-seated user and directs and facilitates capture of waste expelled from the user's anus and urogenital systems into the shaped, held and positioned waste bag for convenient, quick disposal without unwanted mess. The present invention, described more particularly hereinafter, fills that and other needs.

While various devices disclosed in the prior art disclose some of the general structural and operational features of the instant invention, no device in the known prior art includes the overall structure and functional features of the instant invention. The overall structural and functional features of the present invention allow for an improved, durable, portable and reusable assembly conforming to a shape of a user's inner thighs, which is comfortably positioned and held between the user's legs and securely and firmly holds, positions and shapes a waste bag to a portion of a non-seated user, directing and facilitating capture of waste expelled from the user's anus and urogenital systems into the shaped, held and positioned waste bag for disposal.

SUMMARY OF THE INVENTION

It is an object of the present invention to provide a bag holding assembly for securely holding a waste bag in an open position and in a shape conforming to a shape of a portion of a non-seated user. The assembly includes: (1) an elongated frame containing a top opening and an open bottom, the top opening defined by a rim of the frame, the rim having elevated ends and curved medial portions extending between the elevated ends such that the rim conforms to a shape of a groin portion of a non-seated user, the groin portion including and extending around an anus of the user in a posterior aspect, between a pair of user's legs, and including and extending around a urethral opening of the user; and (2) a bag connection member having an elongated groove, the bag connection member being positionable over and around the rim such that the rim and a top portion of a waste bag are positioned in the groove to secure the waste bag to the frame. In preferred embodiments the assembly and particularly the frame thereof conform to a shape of the user's inner thighs when the top opening is positioned adjacent the anus and the urethral opening of the user.

A further object of the present invention is to provide a waste bag holding assembly in accordance with the preceding paragraph which securely positions and holds the waste bag beneath the user's anus and urethral opening and shapes the waste bag to conform to the shape of the portion of the user, directing and facilitating capture of waste expelled from the user's anus and urogenital systems, preventing accidents and unwanted mess.

Yet a further object of the present invention is to provide a waste bag holding assembly of simple structure that is easily, comfortably, quickly and sanitarily used in instances where an adult user occupies a standing, squatting or alternate non-seated position during use.

Another object of this invention is to provide an easily portable waste bag holding assembly in accordance with the preceding objects which conforms to conventional forms of manufacture, which is engagable even with waste bags that themselves lack means for fastening and which is durable, lightweight, reusable, convenient and easy to assemble, use and disassemble.

The more important features of the invention have thus been outlined in the foregoing broad terms in order that the detailed description thereof that follows may be better understood, and in order that the present contribution to the art is better appreciated. Additional features of the invention are described hereinafter and also form the subject matter for the claims appended hereto.

These together with the other objects and advantages of the invention which will become subsequently apparent reside in the details of construction and operation as more fully hereinafter described and claimed, reference being had to the accompanying drawings forming a part hereof wherein like numerals refer to like parts and portions throughout. The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects in addition to those set forth above will become apparent when consideration is given to the following detailed description thereof. Such description makes reference to the annexed drawings wherein.

DETAILED DESCRIPTION OF THE INVENTION

Figure 1:
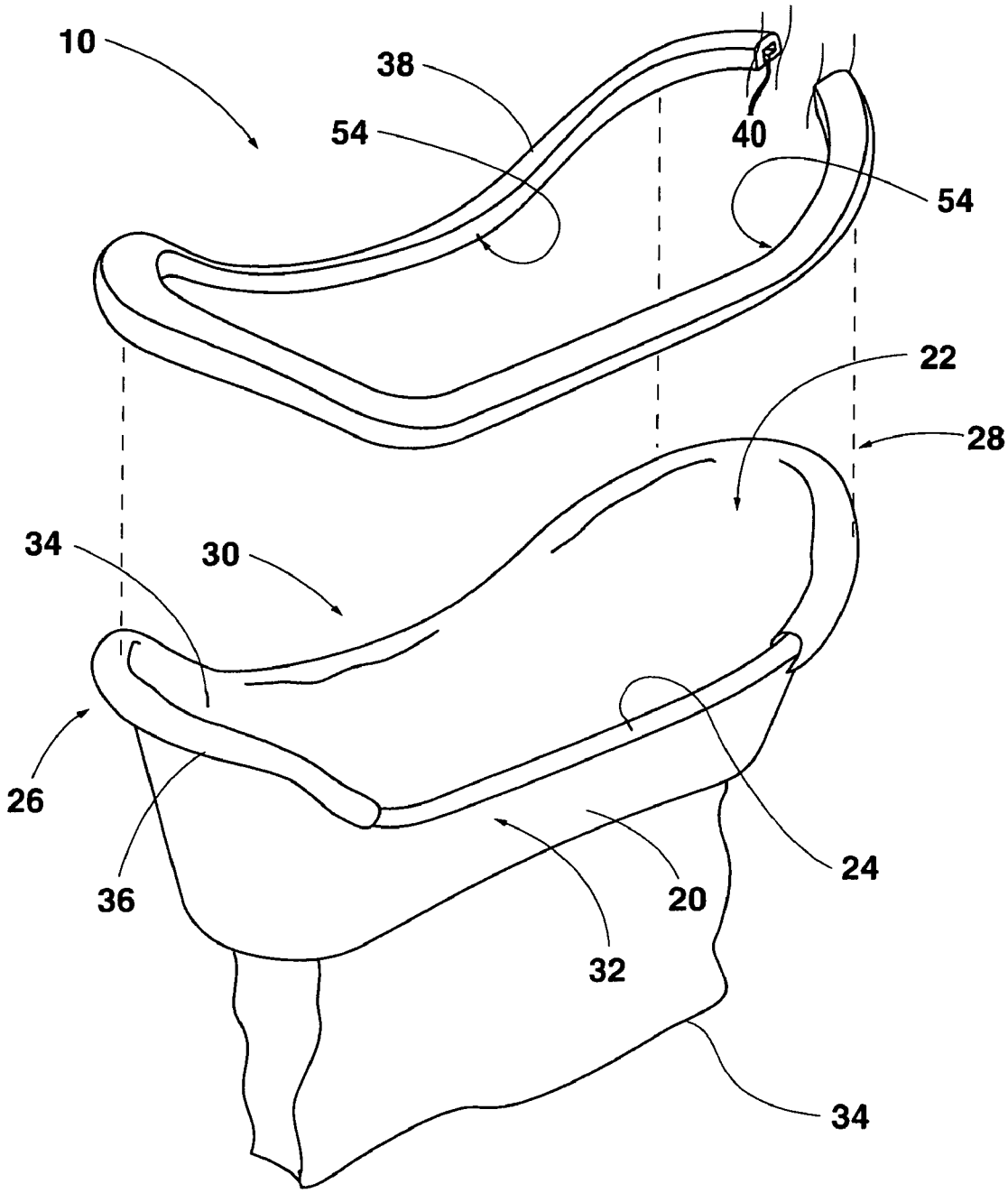
FIG. 1 is a perspective view of a frame and a bag connection member of the present invention's waste bag holding assembly, shown with a portion of a waste bag positioned between the frame and the bag connection member.
Figure 2:
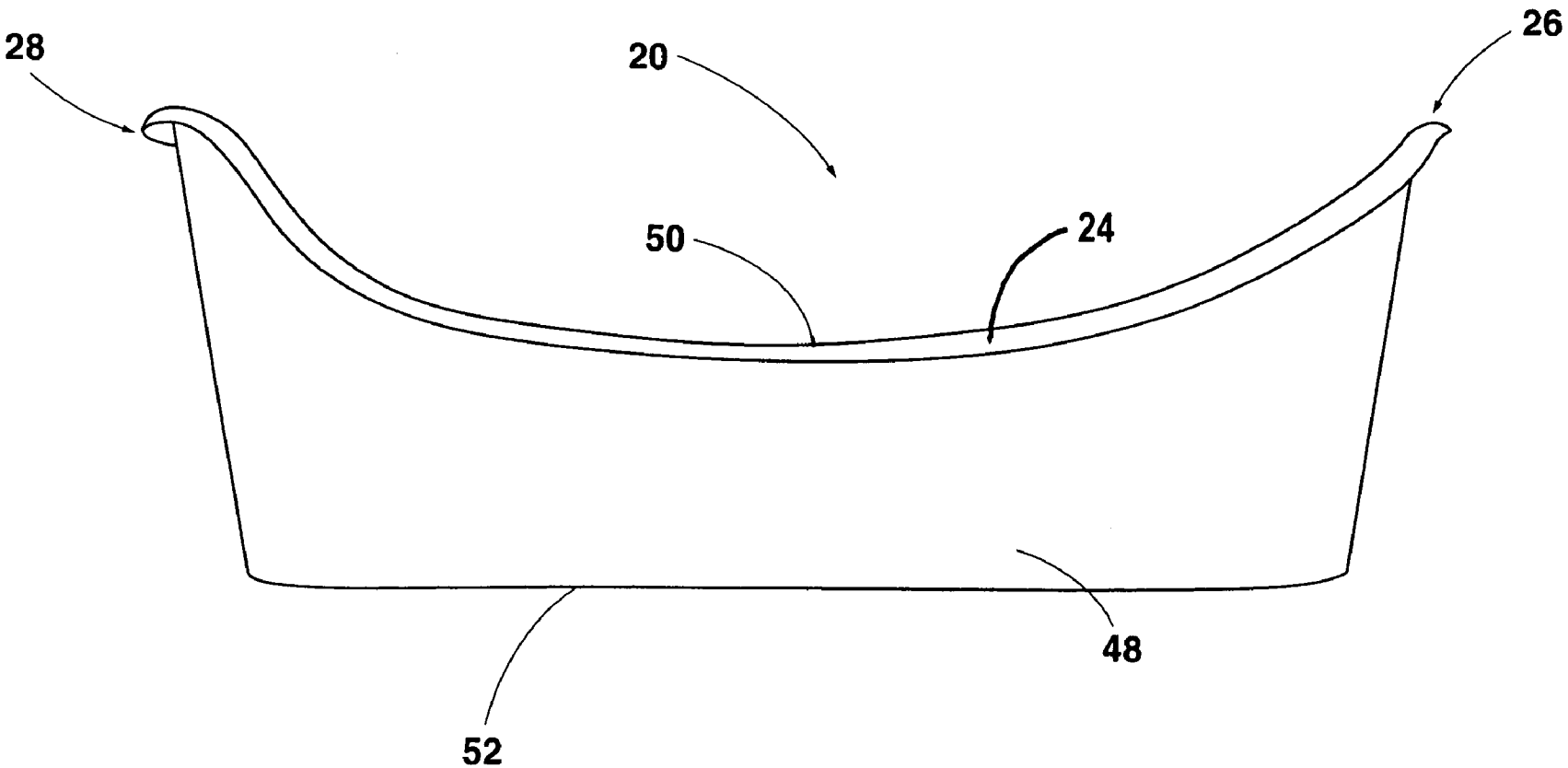
FIG. 2 is an elevated horizontal plan view of the frame of the present invention.

With reference now to the drawings, and particularly to FIGS. 1 through 4 thereof, a new waste bag holding assembly embodying the principles and concepts of the present invention and generally designated by the reference numeral 10 is described hereinafter.

Figure 5:
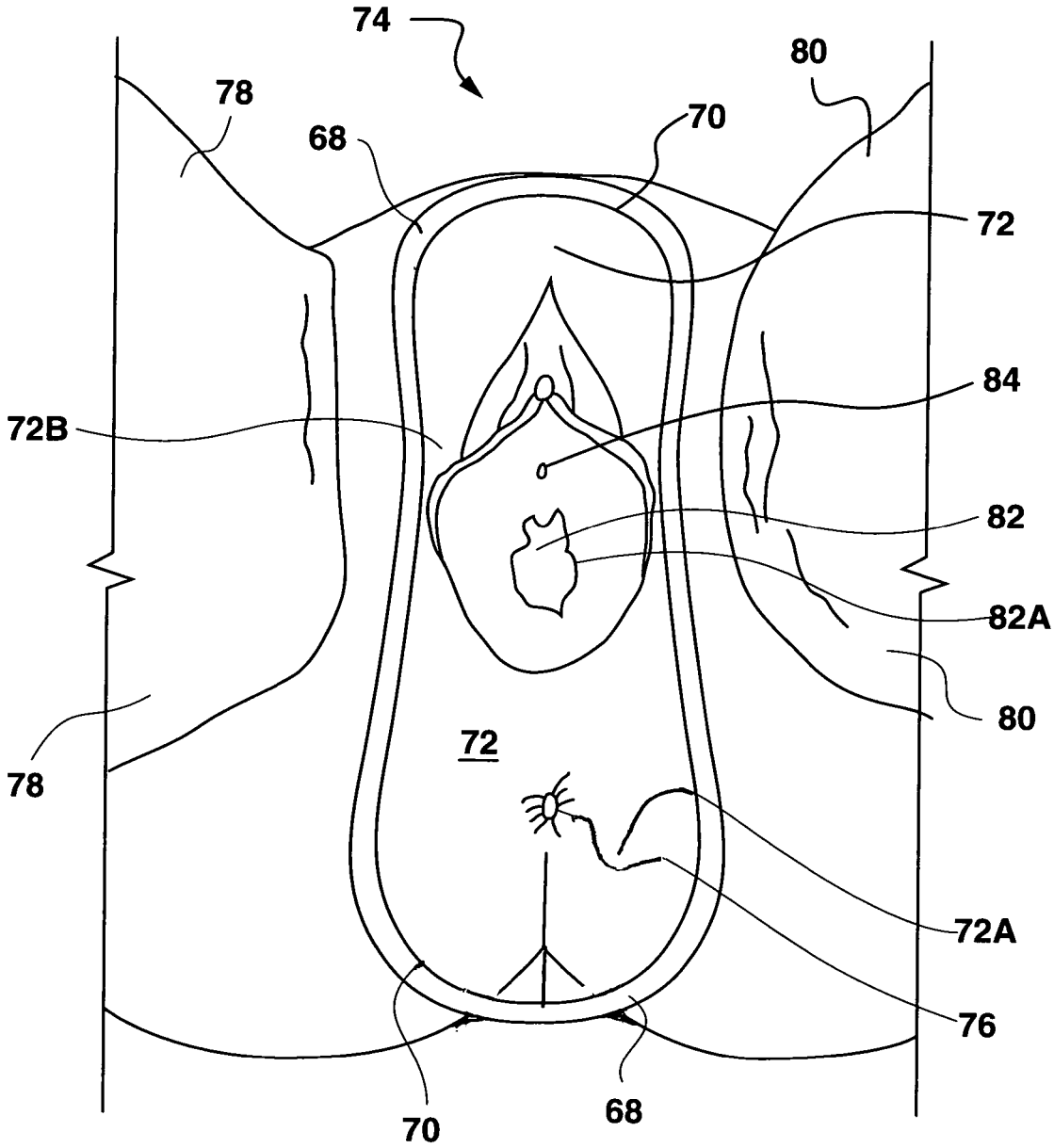
FIG. 5 is a bottom plan view of a portion of a female user engagable with the waste bag holding assembly of the present invention.
Figure 6:
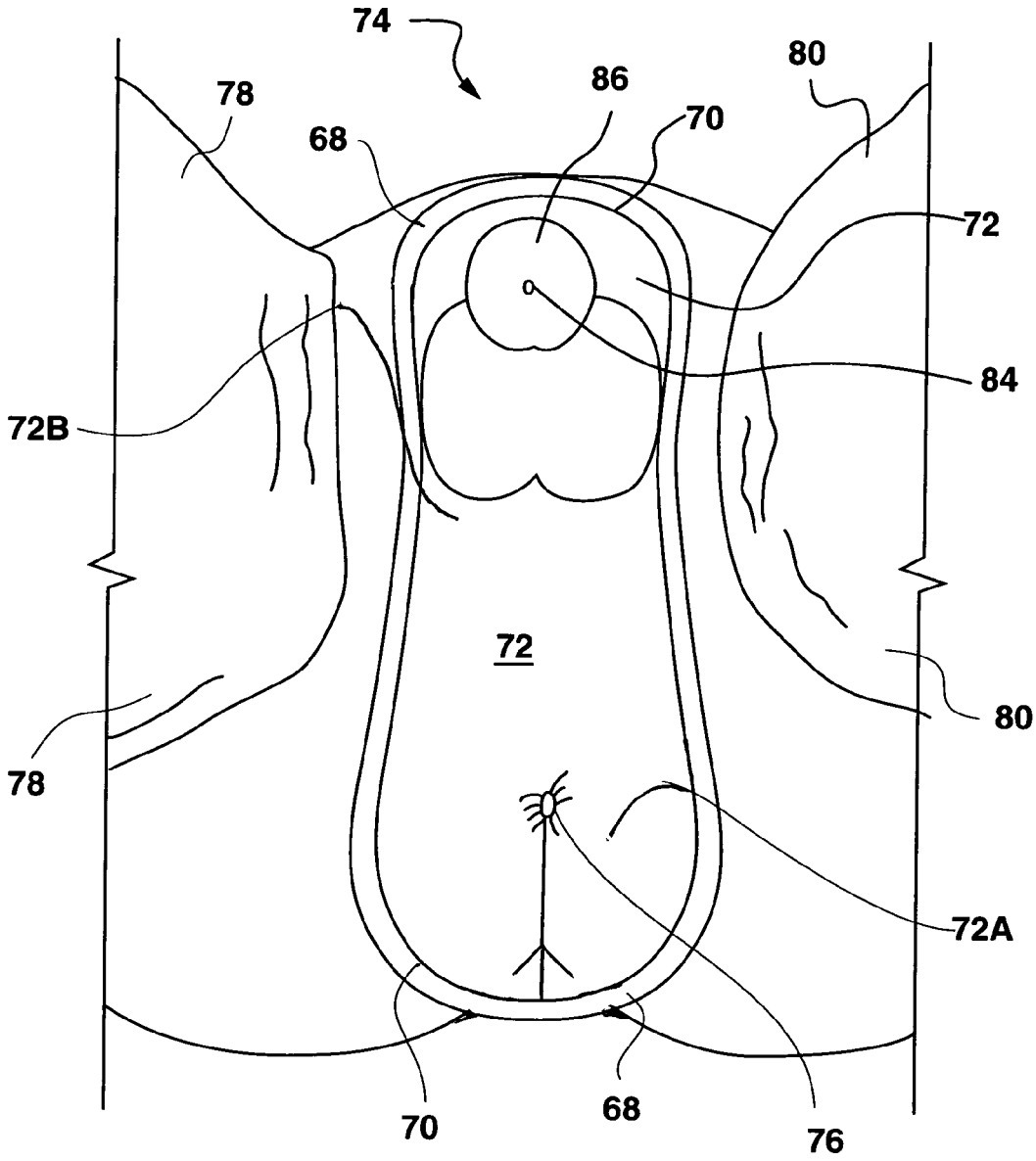
FIG. 6 is a bottom plan view of a portion of a male user engagable with the waste bag holding assembly of the present invention.
Figure 7:
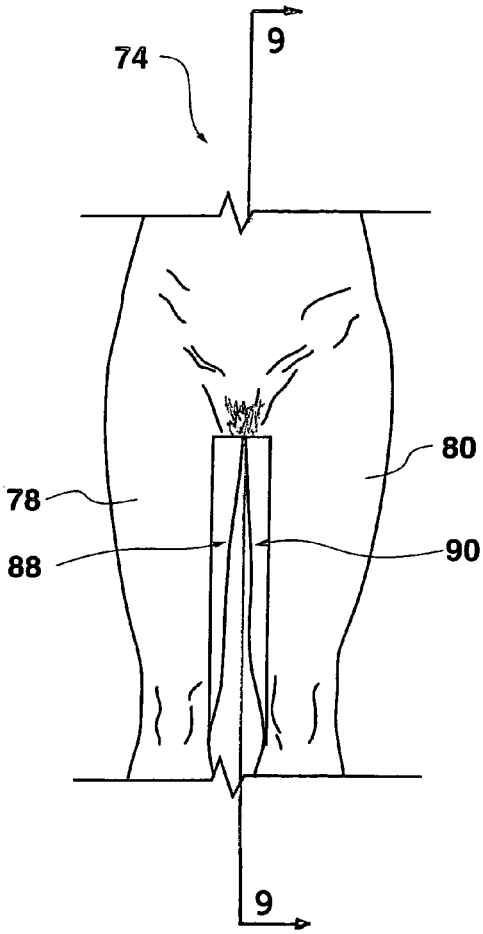
FIG. 7 is a front plan view of a portion of a user engagable with the waste bag holding assembly of the present invention.
Figure 8:
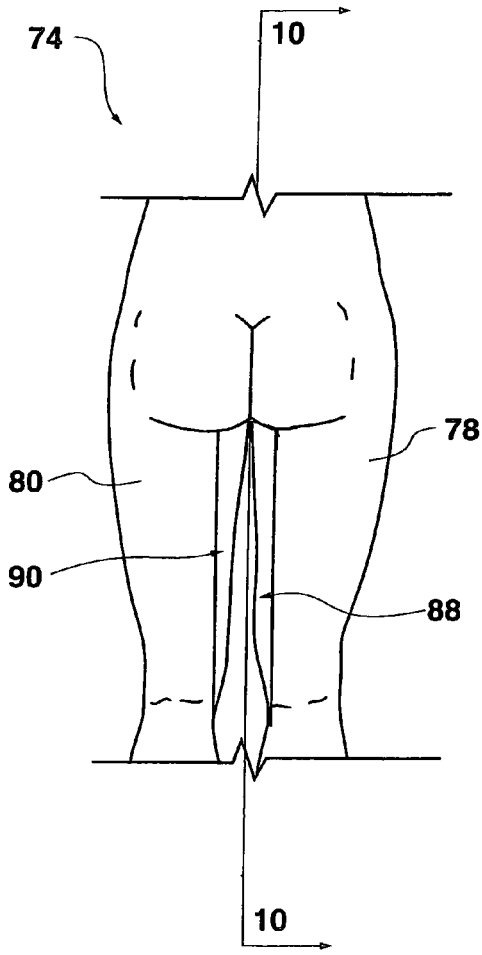
FIG. 8 is a rear plan view of a portion of a user engagable with the waste bag holding assembly of the present invention.

As illustrated in FIGS. 1 through 4, the waste bag holding assembly 10 generally comprises an elongated frame 20 having a top opening 22 defined by a rim 24 of the frame 20. The rim 24 has a plurality of elevated ends 26, 28 and a plurality of curved medial portions 30, 32 disposed between the plurality of elevated ends 26, 28 such that the top opening 22 defined by the rim 24 conforms to a border 68 (best shown in FIG. 5 and FIG. 6) circumscribing a shape 70 of a groin portion 72 of a non-seated user 74, the groin portion 72 including and extending around an anus 76 of the user 74 in a posterior aspect 72A, between a pair of user's legs 78, 80 and including and extending around a urethral opening 84 of the user 74 in a medial-anterior aspect 72B, the groin portion 72 of the user 74 encompassed preferably including and containing an external opening 82A of a vagina 82 of a user 74 having a vagina 82, and preferably including and containing a penis 86 of a user 74 having a penis 86.

In standard use, a waste bag 34 is positioned in the frame 20 such that a top portion 36 of the waste bag 34 extends over and around the rim 24 as best shown in FIG. 1. A bag connection member 38 has an elongated groove 40 positionable over and around the rim 24 such that the rim 24 and the top portion 36 of the waste bag 34 are positioned in the groove 40 securing the waste bag 34 to the frame 20 in an open position for receiving waste from the user 74.

The bag connection member 38 is elastomeric and preferably constructed of rubber for ease of use, comfort and sanitation. The bag connection member 38 is further resiliently flexible to facilitate attachment of the bag connection member 38 to the rim 24 of the frame 20 and thereby facilitate a connection between the waste bag 34 and the frame 20.

Figure 3:
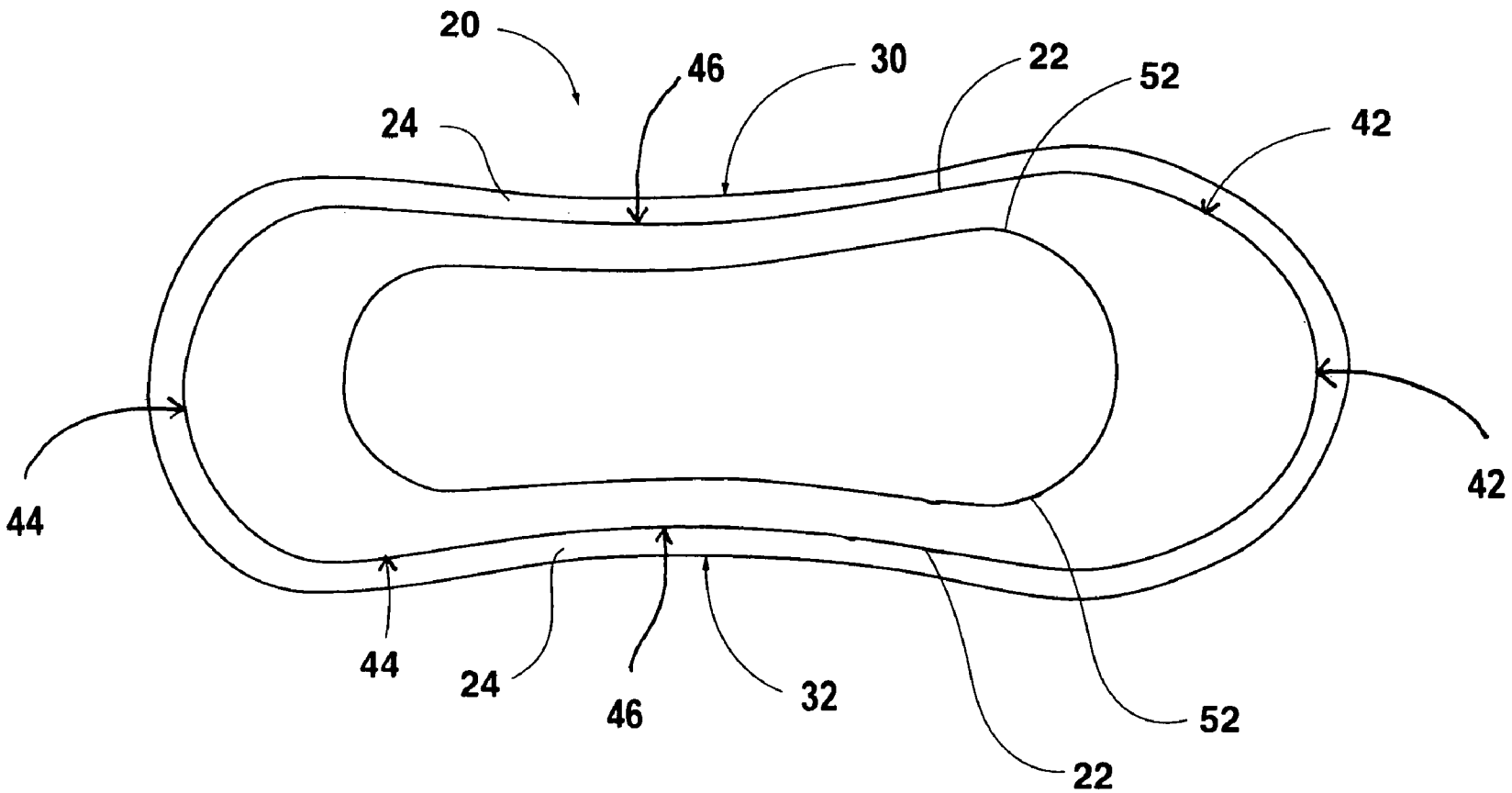
FIG. 3 is a top plan view of the frame of the present invention.
Figure 4:
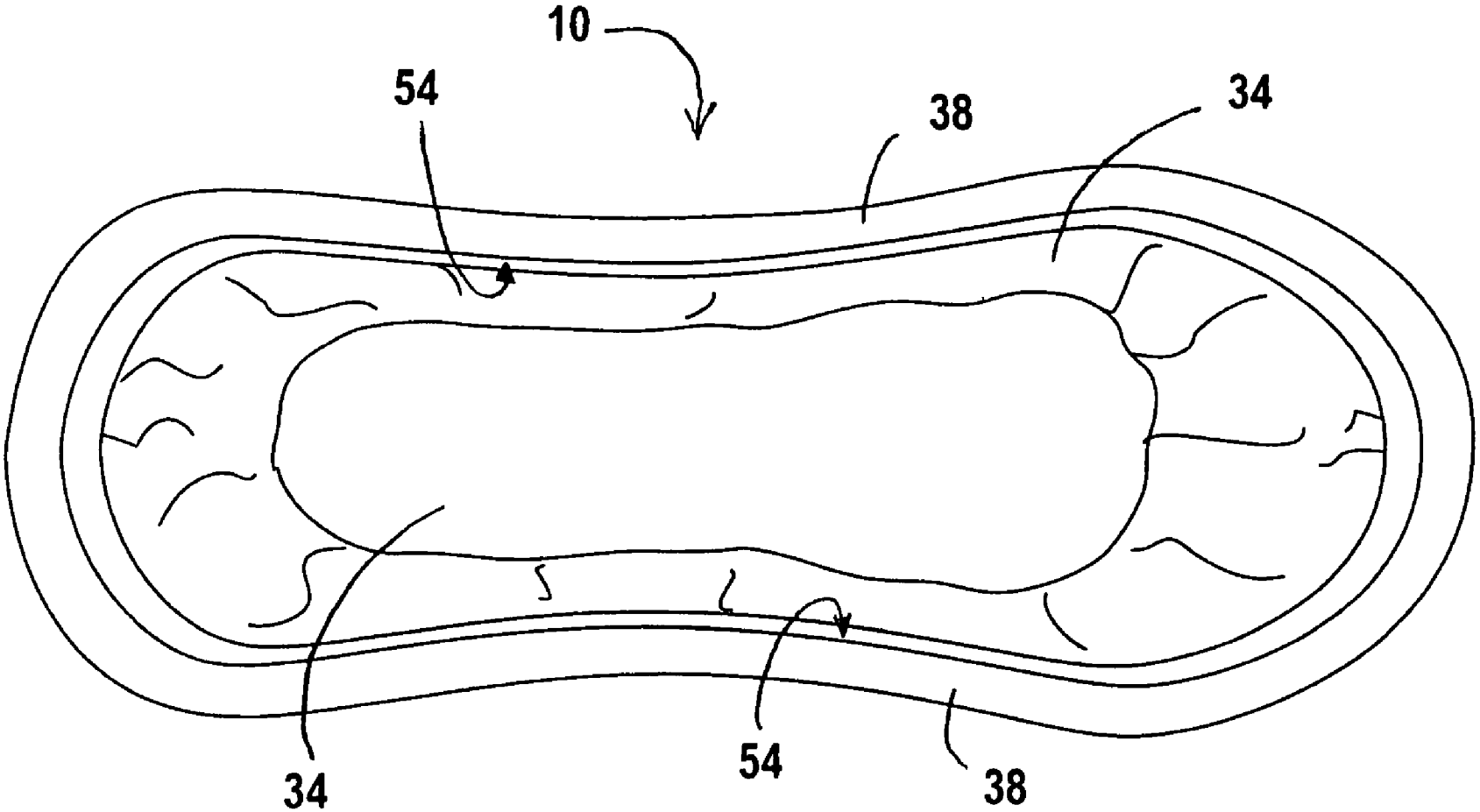
FIG. 4 is a top plan view of the present invention's waste bag holding assembly, shown with a waste bag positioned between the frame and the bag connection member.
Figure 9:
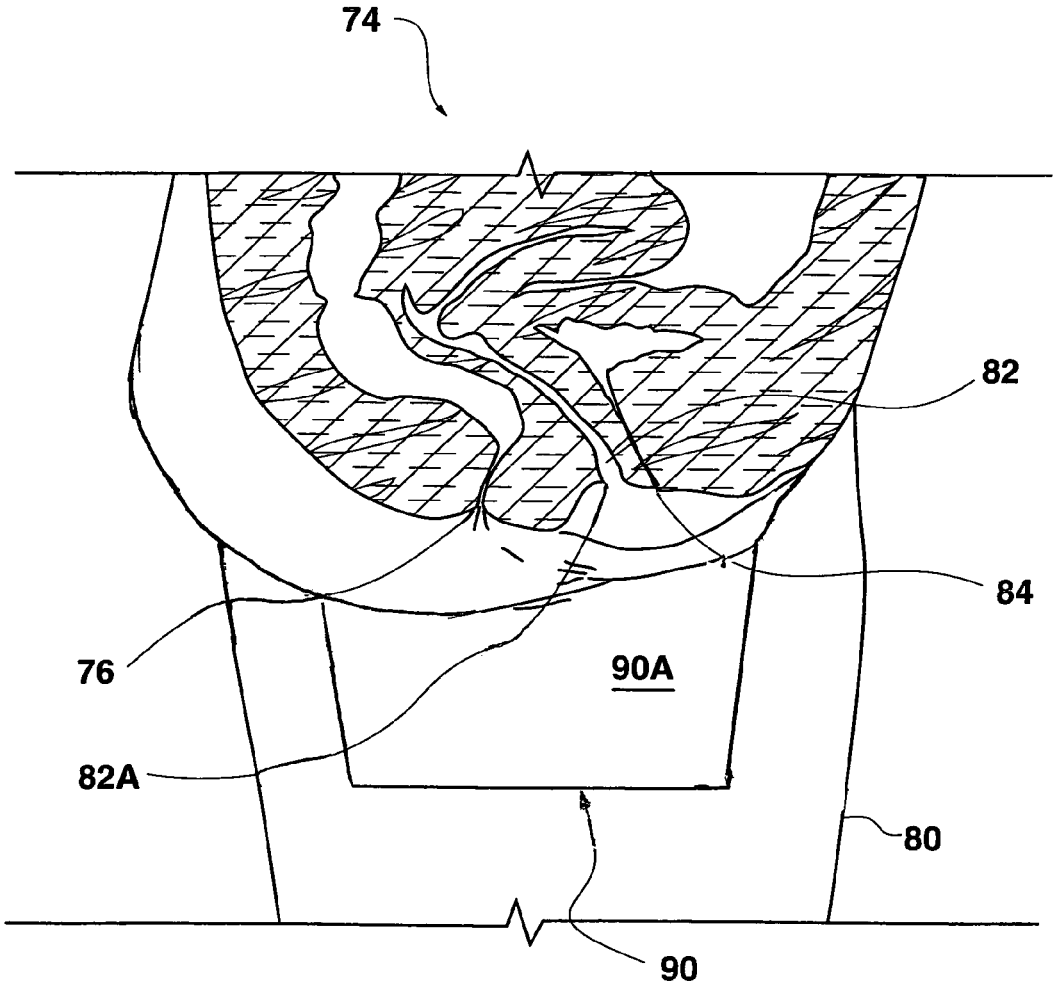
FIG. 9 is a sectional view taken through line 9-9 of FIG. 7.
Figure 10:
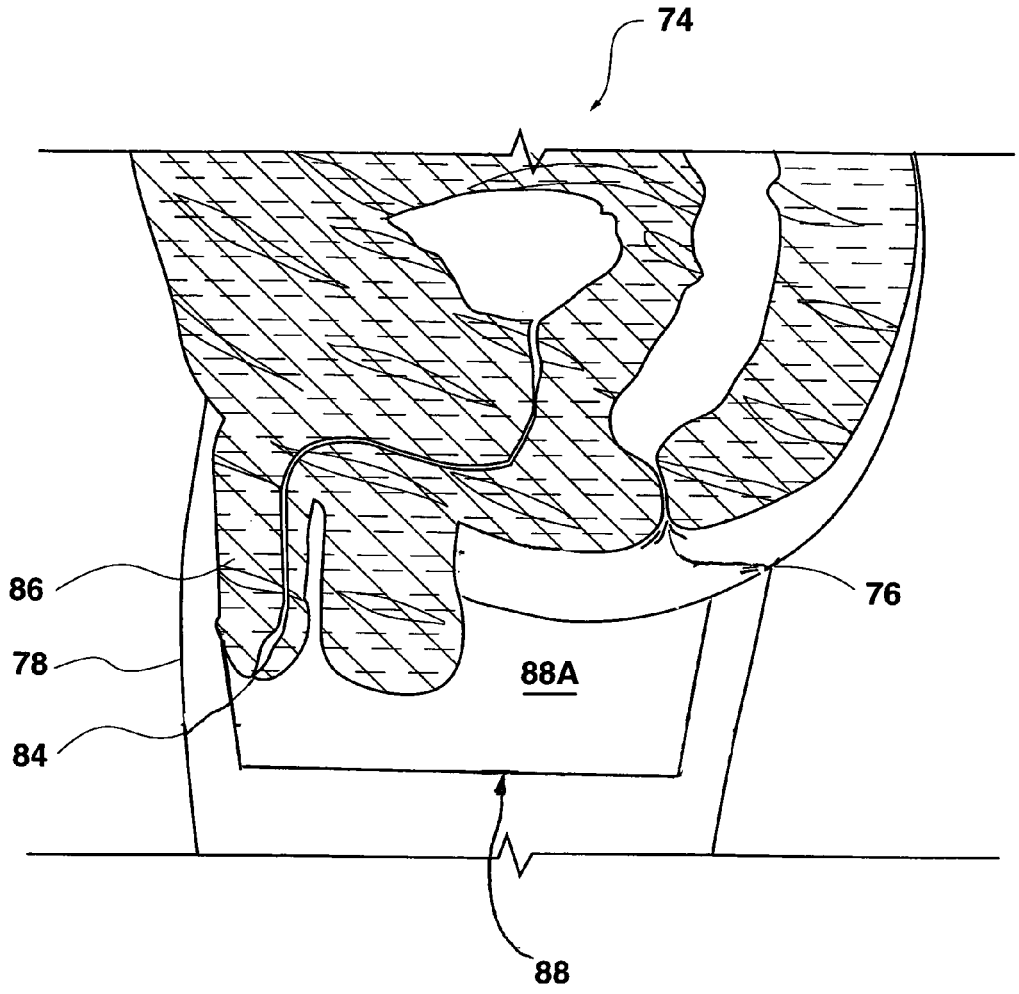
FIG. 10 is a sectional view taken through line 10-10 of FIG. 8.

Referring to an embodiment illustrated in FIG. 3, the top opening 22 has a plurality of bulbous ends 42, 44 and a tapered central portion 46 which borders and is disposed between the plurality of curved medial portions 30, 32 and the plurality of curved medial portions 30, 32 conform to at least an upper aspect of a pair of user's inner thighs 88, 90 when the top opening 22 is positioned adjacent the anus 76 and the urethral opening 84 of the user 74 and particularly, in a preferred embodiment, to at least an upper aspect 88A, 90A of the pair of user's inner thighs 88, 90 best seen in FIG. 9 and FIG. 10. The sides of the frame 20 are angled such that the top opening 22 tapers inwardly from the top of the frame 20 towards the bottom of the frame 20 as best shown in FIG. 3 to assist inter alia in shaping the waste bag 34 and in directing waste expelled from the user 74.

In preferred embodiments of the invention, a wider end of the top opening 22 placed proximate the user's anus 76 in standard use preferably has a maximum width of 4 to 6 inches and an optimum maximum width of 4.4 to 4.6 inches. A narrower end of the top opening 22, preferably placed proximate the user's penis 86 or vagina 82 in standard use has a maximum width of 3.25 to 5.25 inches with an optimum maximum width of the narrower end being about 3.7 to 3.8 inches. The length of the top of the frame 20 as measured in a single plane between a pair of most mutually distant points on said plurality of elevated ends 26, 28 is preferably between 9 and 12 inches. A maximum height of the frame 20 at the narrower end and a maximum height of the frame 20 at the broader end are preferably at least 2 inches greater than a height of the curved medial portions 30, 32 having least height. A segment of the curved medial portions 30, 32 having least height is preferably spaced at a distance from a most anterior aspect of the frame 20 equal to between 25% and 65% of a length of the frame 20 at an elevation equivalent to the segment of the curved medial portions 30, 32 having least height. The segment of the curved medial portions 30, 32 having least height is preferably at least 2 inches in height.

The rim 24 of the frame 20 is stably positioned in spaced relationship to a bottom of the frame 20. It is preferred that a continuous wall 48 forms the frame 20. It is also preferred that the wall 48 tapers inwardly from an open top 50 to an open bottom 52 of the wall 48 at a generally constant angle, the angle being preferably between 5 and 20 degrees from vertical when the open bottom 52 occupies a horizontal position, and being ideally between 10 and 12 degrees from vertical when the open bottom 52 occupies the horizontal position. In a preferred embodiment, the connection member has an inverted U-shaped cross-section and the rim 24 is disposed outwardly from the remainder of the frame 20 and away from the top opening 22 to aid in reducing protrusion of an inwardly facing side 54 of the bag connection member 38 into the top opening 22 of the frame 20.

In a preferred embodiment, the elongated groove 40 has an inverted L-shaped cross-section to aid in positioning and securing the waste bag 34 and in reducing protrusion of the inwardly facing side 54 into the top opening 22.

In use, the waste bag 34 is placed into the frame 20 and the top portion 36 of the waste bag 34 is positioned to extend over and around the rim 24 of the frame 20 as best illustrated in FIG. 1. The bag connection member 38 is then pressed onto the rim 24 to snugly and securely couple the waste bag 34 to the frame 20 around the rim 24 thereby conforming the top portion 36 of the waste bag 34 to a border 68 circumscribing a shape 70 of a groin portion 72 of a user 74, the groin portion 72 of the user 74 including and extending around an anus 76 of the user 74 in a posterior aspect 72A, between a pair of user's legs 78, 80 and including and extending around a urethral opening 84 of the user 74 in a medial-anterior aspect 72B. The user may then position the frame 20 and the waste bag 34 connected thereto comfortably against the user with the medial portions 30, 32 of the frame 20 comfortably positioned and held between the user's inner thighs 88, 90 to direct and facilitate the capture of urine, fecal material and other waste expelled from the anus 76, the urethral opening 84, and the vagina 82 or the penis 86 of the user 74 into the waste bag 34.

With respect to the above description, it is to be realized that the optimum dimensional relationships for the parts of the invention, to include variations in size, materials, shape, form, function and manner of operation, assembly and use, may be readily apparent and obvious to one skilled in the art, and all equivalent relationships to those illustrated in the drawings and described in the specification are intended to be encompassed by the present invention. Further features of each embodiment may be interchanged except for those features that are specifically mutually exclusive.

Therefore, the foregoing is considered as illustrative only of the principles of the invention. Further, since modifications and changes will occur to those skilled in the art, it is not desired to limit the invention to the exact construction and operation shown and described, and accordingly, all suitable modifications and equivalents may be resorted to, falling within the scope of the invention. The frame 20 is preferentially composed of plastic or of a comparable durable, lightweight and water-resistant material and is reusable.

What is claimed is:

1. A waste bag holding assembly, said assembly comprising:

a) an elongated frame containing a top opening and an open bottom, said top opening being defined by a rim of said frame, said rim having a plurality of elevated ends and a plurality of curved medial portions disposed between said plurality of elevated ends such that said top opening defined by said rim conforms to a border circumscribing a shape of a groin portion of a non-seated user, said groin portion of said user including and extending around an anus of said user, between a pair of user's legs and including and extending around both a urethral opening and an external opening of a vagina of said user;

b) a bag connection member having an elongated groove, said bag connection member being positionable over and around said rim such that said rim and a top portion of a waste bag are positioned in said groove securing said waste bag to said frame;

wherein said waste bag is positioned in said frame such that said top portion of said waste bag extends over and around said rim and thereby conforms to said border; and wherein said top opening has a plurality of bulbous ends to facilitate directing and capturing of waste expelled from said anus, said vagina and said urethral opening of said user and a tapered central portion, said tapered central portion bordering and being disposed between said plurality of medial portions of said frame and said plurality of medial portions conforming to at least an upper aspect of a pair of user's inner thighs and being positioned and held between said thighs when said top opening is positioned adjacent said anus, said vagina and said urethral opening of said user.

2. The waste bag holding assembly of claim 1, wherein said frame is formed by a continuous wall.

3. The waste bag holding assembly of claim 2, wherein said wall tapers inwardly from a top to a bottom of said wall.

4. The waste bag holding assembly of claim 1, wherein said bag connection member is resiliently flexible facilitating attachment of said bag connection member to said rim.

5. The waste bag holding assembly of claim 4, wherein said bag connection member is rubber.

6. The waste bag holding assembly of claim 1, wherein said bag connection member has an inverted U-shaped cross section for reducing protrusion of an inwardly facing side of said bag connection member into said top opening.

7. A waste bag holding assembly, said assembly comprising:

a) an elongated frame containing a top opening and an open bottom, said top opening being defined by a rim of said frame, said rim having a plurality of elevated ends and a plurality of curved medial portions disposed between said plurality of elevated ends such that said top opening defined by said rim conforms to a border circumscribing a shape of a groin portion of a non-seated user, said groin portion of said user including and extending around an anus of said user, between a pair of user's legs and including and extending around a urethral opening in a penis of a user;

b) a bag connection member having an elongated groove, said bag connection member being positionable over and around said rim such that said rim and a top portion of a waste bag are positioned in said groove securing said waste bag to said frame;

wherein said waste bag is positioned in said frame such that said top portion of said waste bag extends over and around said rim and thereby conforms to said border; and wherein said top opening has a plurality of bulbous ends to facilitate directing and capturing of waste expelled from said anus and said urethral opening of said user and a tapered central portion, said tapered central portion bordering and being disposed between said plurality of medial portions of said frame and said plurality of medial portions conforming to at least an upper aspect of a pair of user's inner thighs and being positioned and held between said thighs when said top opening is positioned adjacent said anus and said urethral opening of said user.

8. The waste bag holding assembly of claim 7, wherein said frame is formed by a continuous wall.

9. The waste bag holding assembly of claim 8, wherein said wall tapers inwardly from a top to a bottom of said wall.

10. The waste bag holding assembly of claim 7, wherein said bag connection member is resiliently flexible facilitating attachment of said bag connection member to said rim.

11. The waste bag holding assembly of claim 10, wherein said bag connection member is rubber.

12. The waste bag holding assembly of claim 7, wherein said bag connection member has an inverted U-shaped cross section for reducing protrusion of an inwardly facing side of said bag connection member into said top opening.

* * * * *